US005730363A

United States Patent [19]

Kress

[11] Patent Number: 5,730,363

[45] **Date of Patent: *Mar. 24, 1998**

[54] SHOWER HEAD

[75] Inventor: Hermann Kress, Filderstadt, Germany

[73] Assignee: Hansa Metallwerke A.G., Stuttgart, Germany

[ * ] Notice: The term of this patent shall not extend beyond the expiration date of Pat. No. 5,702,057.

[21] Appl. No.: 580,244

[22] Filed: Dec. 28, 1995

[30] Foreign Application Priority Data

Dec. 29, 1994 [DE] Germany ..... 44 47 114.9

[51] Int. Cl.[6] ..... B05B 15/02

[52] U.S. Cl. ..... 239/123; 239/447; 239/553; 239/596; 239/602

[58] Field of Search ..... 239/104, 106, 239/107, 109, 116, 117, 123, 548, 436, 447, 552, 553, 553.3, 554, 596, 602, DIG. 12

[56] References Cited

U.S. PATENT DOCUMENTS

| | | | |
|---|---|---|---|
| 2,402,741 | 6/1946 | Drauiner | 239/602 |
| 4,629,124 | 12/1986 | Gruber | 239/428.5 |
| 5,172,862 | 12/1992 | Heimann et al. | 239/114 |
| 5,228,625 | 7/1993 | Grassberger | 239/558 |
| 5,405,089 | 4/1995 | Heimann et al. | 239/533.14 |

FOREIGN PATENT DOCUMENTS 90 17 978 U 6/1993 Germany .

*Primary Examiner*—Andres Kashnikow
*Assistant Examiner*—Lisa Ann Douglas

[57] ABSTRACT

The shower base (1) of an otherwise conventional shower head comprises a perforated plate (1*a*) made of a rigid material and a jet insert (1*b*) which is made of a flexible material and which is attached to the perforated plate (1*a*) in such a way that it can be removed. The jet insert (1*b*) consists of a base plate (9) which extends along the outer surface of the perforated plate (1*a*) and protects it against impact damage. There are preformed on to the base plate (9) of the jet insert (1*b*) a number of hose-type jet attachments (10) each of which extend through a hole (3) in the perforated plate (1*a*), going from outside in, in fact, such that the free ends of the jet attachments (10) are located inside the shower head. The jet insert (1*b*) has a locking device (32), with which it is secured to the perforated plate (1*a*) in such a way that it can be removed. The entire jet insert (1*b*) can be removed from the perforated plate (1*a*) by applying axial pull, without having to dismantle the shower base (1) from the shower head housing. The entire jet insert (1*b*) which is removed from the shower head can easily be cleaned and in particular manual flexing can be carried out to remove limescale deposits which build up on the wall surface of the jet channels (13) going through the jet attachments (10), especially in the area around the water outlet openings (15) (FIG. 1).

5 Claims, 3 Drawing Sheets

SHOWER HEAD

Figure 1:
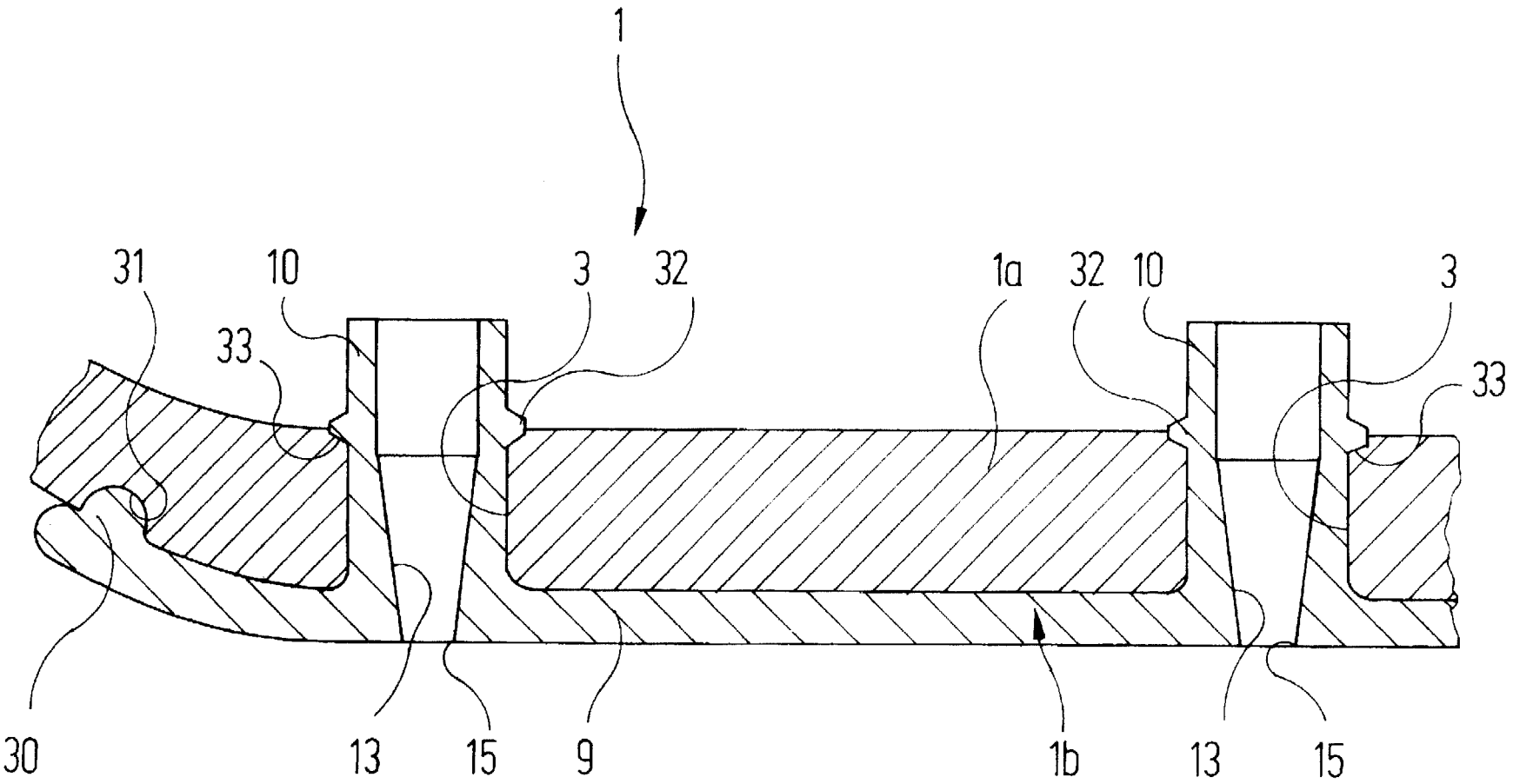

The invention concerns a shower head, especially for a hand shower, comprising a) an essentially bell-shaped housing, in which at least one water chamber is formed which can be connected to a water supply channel;

b) a shower base, which closes the bell-shaped housing at the bottom and consists of:

ba) a perforated plate made of a rigid material, which has a number of holes;

bb) a jet insert made of a flexible material which is attached to the perforated plate in such a way that it can be removed, which consists of a base plate resting against one surface of the perforated base and a number of hose-type jet attachments preformed in one piece on the base plate, each of which has a jet channel terminating in a water outlet opening going through them and each of which passes through a hole in the perforated plate.

It is known that the water outlet openings on shower bases have a tendency to fur up over the course of the useful life of the shower head. This first manifests itself in a jet pattern, the geometry of which differs from that in its new condition and also in a lower output per liter delivered. The limescale deposits can build up until finally the water outlet openings are completely blocked. For this reason, as described in DE-GM 90 17 978 for example, water outlet openings are known which are made on hose-type jet attachments which protrude a certain distance above the outer surface of the shower base. The hose-type jet attachments are made of an elastomer material and can be automatically flexed by stroking the hand over them so that the limescale deposits on the surfaces of the jet channels, especially in the area around the water outlet openings, can be dislodged. The flow of water through the water outlet openings in the shower base is then once again free running.

A shower head of the type initially described is already known on the market. Its shower base consists of a rigid perforated plate with a number of holes and a flexible jet insert which has a number of jet attachments. All the jet attachments are preformed on to a base plate of the jet insert. When mounted, this lies against the inside of the perforated plate so that the pressure of the water presses the jet insert against the perforated plate. The jet attachments pass through the holes in the perforated plate from inside out, such that the free ends of the jet attachments form the water outlet openings. If the jet channels which pass through the jet attachments and which at their outer end delimit the water outlet openings become blocked by limescale deposits or become dirty, then the perforated base of the known shower head is removed from the housing. The jet insert can now be removed from the inside of the perforated plate and flexed by hand or cleaned in some other manner. After cleaning, the jet insert is once again secured in position on the inner surface of the perforated plate; the shower base, having thus been pre-assembled, is then re-installed on the housing of the shower head. This process, which has to be carried out each time the jet insert has to be cleaned, is however relatively complicated.

The task of this invention is to design a spray head of the type described initially, so that the jet insert can be removed and cleaned without any difficulty.

This problem is solved by the invention, in that c) the base plate of the jet insert rests against the outer surface of the perforated plate, and d) the jet attachments are pushed through the holes in the perforated plate from outside, such that their free ends are located inside the shower head.

According to the invention the jet insert is, therefore, positioned against the rigid perforated plate; the jet inserts pass through the holes in the perforated plate from outside in so that the water outlet openings are now formed not at the free ends of the jet attachments which lie inside the shower head, but at the end which is attached to the base plate of the jet insert. Special locking devices ensure that the jet insert does not become detached from the rigid perforated plate, even under the pressure of the water which is present in the chamber inside the shower head. An additional advantage of the design according to the invention is that the outer surface of the shower base is formed by the base plate which is made of a flexible material and therefore this base plate protects the entire shower base against damage by impact.

The simplest design of the invention is one in which a) the outer diameter of the jet attachments of the jet inserts coincides with the diameter of the holes in the perforated plate, and b) there is preformed on to the outer surfaces of each of the jet attachments a radially protruding retaining band which, when fitted, rests against the inner surface of the perforated plate.

With regard to cleaning capability, an even better design of the invention, though one which is slightly more expensive, is one in which a) the outer diameter of the jet attachments of the jet inserts is smaller than the diameter of the holes in the perforated plate;

b) there are preformed on to the base plate of the jet insert retaining collars which go round each jet attachment and whose outer diameter matches the diameter of the holes in the perforated plate;

c) there is preformed on to the outer shell surface of each of the retaining collars a radially protruding retaining band which, when fitted, rests against the inner surface of the perforated plate.

In this embodiment, there is formed, between the jet attachments and the retaining collars, a circular space which, to a certain extent, allows the jet attachments to be flexed by hand without having to remove the jet insert from the perforated plate.

The removal of the jet insert from the perforated plate is simplified if the retaining band rests against a chamfer at the inside end of the corresponding hole.

Shower heads of the type concerned here are frequently manufactured as so-called "multi-function showers". This means that the water which generally flows through the handle is transferred to one of two water chambers formed in the housing by means of a change-over valve. The two water chambers are each connected to a set of outlet openings in the shower base, whereby the different character of the emerging jets of water in the two modes of operation is provided by an appropriate geometry of the water outlet openings and/or a further treatment of the water, e.g. by adding air. The most common design of multi-function shower is one in which in one mode of operation so-called "hard jets" emerge at relatively high speed and have a relatively narrow cross-section and in a second mode of operation so-called "soft jets" emerge which have air added to them and have a relatively large cross-section. If the concept according to the invention is applied to a multi-function shower of this type, then a particularly effective design of the invention is one in which the clear circular spaces connect with one of the water chambers and in addition are connected to the outer surface of the shower base via ring-segment shaped openings. The outlet openings of one type of jet, e.g. soft jets, are therefore located in essentially the same place as the outlet openings of another type of jet, e.g. those of the hard jets; the "rough" jet pattern of the shower head is therefore the same in both modes of operation.

Embodiments of the invention are explained in greater detail below, with the help of the drawings.

Figure 2:
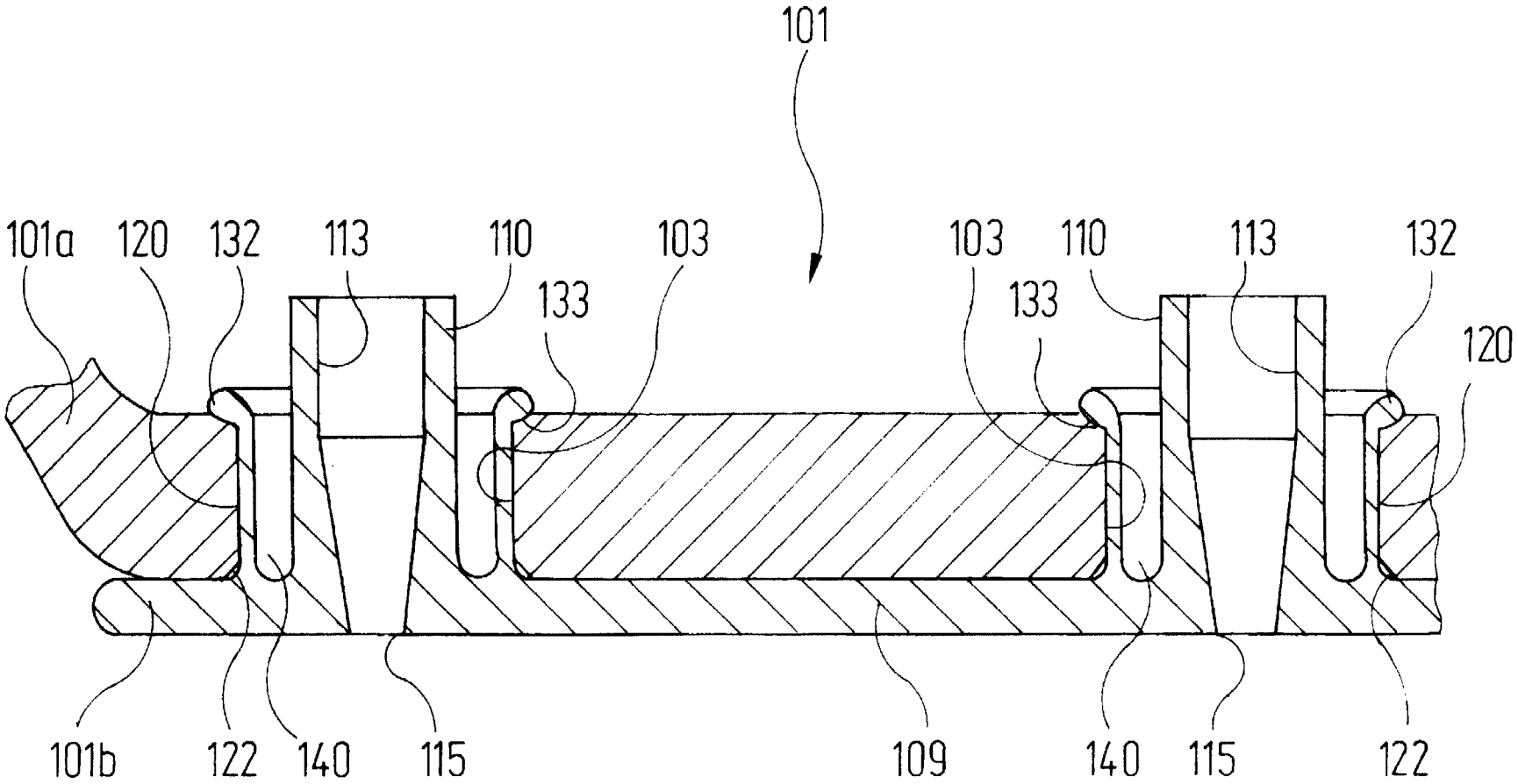
Figure 3:
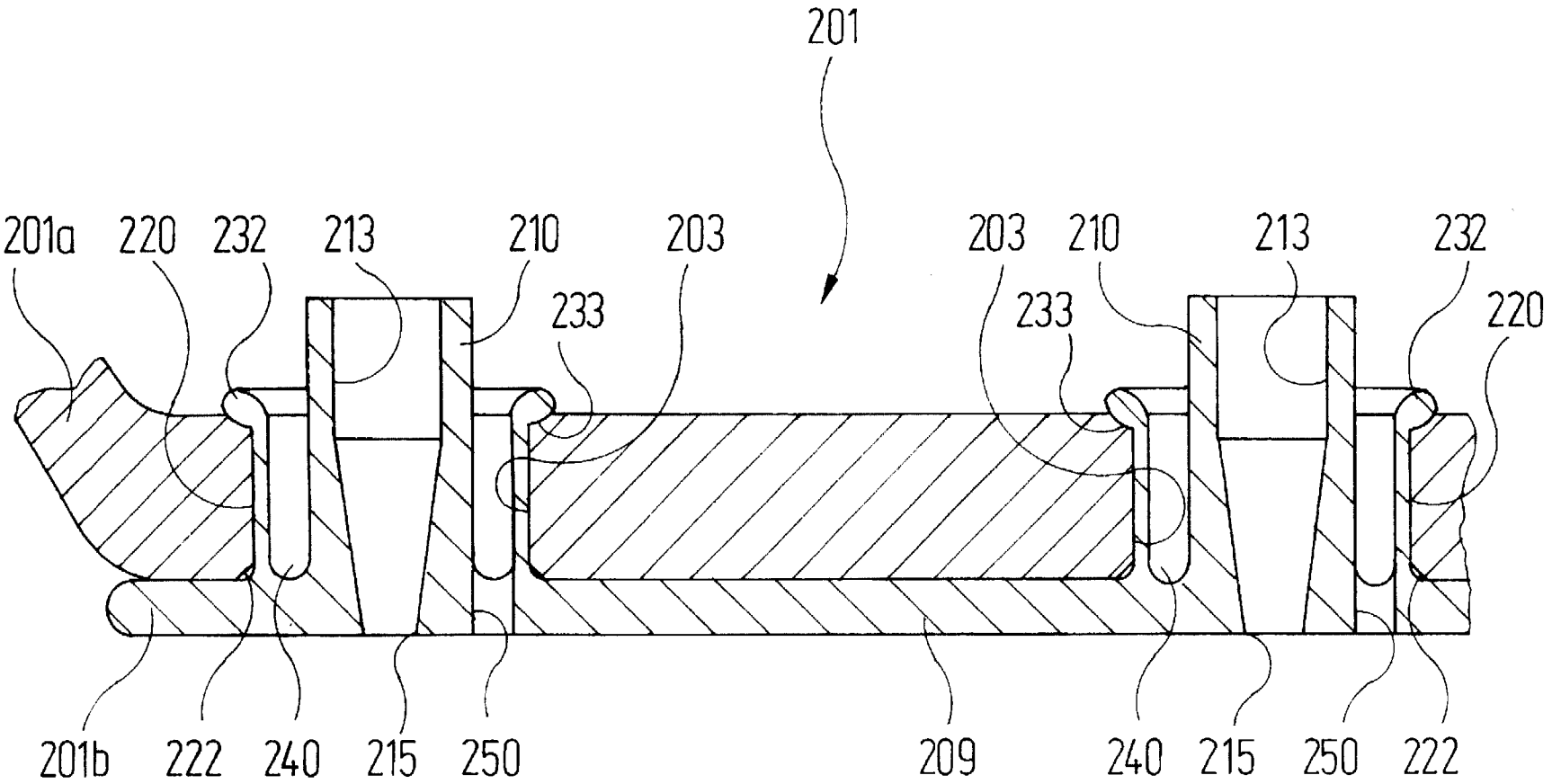

FIG. 1: shows an area from a radial section through the shower base of a shower head;

FIG. 2: shows a radial section, similar to that of FIG. 1, through a second embodiment of a shower base;

FIG. 3: shows a radial section, similar to that of FIG. 2, through a second embodiment of a shower base.

The reference number 1 in FIG. 1 designates a multi-part shower base which, in the conventional manner, forms the lower closure of a bell-shaped housing, not shown. It is generally circular and at its outer circumference merges into the housing of the shower head—either in one piece or via a detachable connection.

The shower base 1 consists of a perforated plate la made of a relatively rigid material, which has several sets of holes 3 in concentric circles around its centre axis which is no longer shown in the drawing, but which is to be imagined further to the right of this.

The shower base 1 also consists of a jet insert which altogether has the reference number 1*b*. The jet insert 1*b* is made of a deformable elastomer synthetic material and is attached to the perforated plate so that it can be removed, in a manner still to be described. As can be seen from FIG. 1, the jet insert 1*b* consists of an essentially flat base plate 9, which extends along the outer and thus underside of the perforated plate 1*a* up its outer edge. Fitted to the base plate 9 of the jet insert 1*b* in the area around the outer rim is a ring-shaped sealing bead 30, which sits in a similarly shaped groove 31 on the underside of the perforated plate 1*a*.

There are injection moulded on to the base plate 9 of the jet insert 1*b*, concentric to the sets of holes 3 in the perforated plate 1*a*, hose-type jet attachments 10, which extend through the corresponding holes 3 in the perforated plate 1 into the inside of the shower head. The outer diameter of the jet attachments thereby match the diameter of the holes 3 in the perforated plate 1*a*.

The surfaces of the jet attachments 10 are each moulded with a ring-shaped retaining band 32, the axial height of which is selected so that, when fitted, the retaining band 32 lies on the inner surface of the perforated plate 1*a* or on a chamfer 33 made in the area at the end of the holes 3 there.

Each of the jet attachments 10 have jet channels 13 going axially through them, which taper conically at their outer area, such that the jets of water flowing through these channels and issuing from the outlet openings 15 become concentrated and are caused to accelerate.

The shower head described above operates as follows:

When the shower head is in operation, the jet channels going through the jet attachments 10 are supplied, from above, with water in a manner which is of no concern here. Over the course of time, limescale builds up inside the jet channels 13, but especially in the area around the outlet openings 15 with their relatively small cross-section, which reduces the clear cross-section of flow and can finally lead to a complete blockage of the jet channels 13. If such a state occurs, the entire jet insert 1*b* can be removed from the perforated plate 1*a*, by pulling axially; the chamfers 33 in the top end around the holes 3 in the perforated plate 1*a* are useful for this process. If the jet insert 1*b* is detached from the shower head, then it can be flexed by hand such that the limescale which has built up on the walls of the jet channels 13 is dislodged. In addition, of course, the jet insert 1*b* can also be cleaned using a suitable cleaning device, e.g. a sponge, or using cleaning agents.

On completion of cleaning, the jet attachments 10 on the jet insert 1*b* are inserted back into the appropriate holes 3 in the perforated plate 1*a*. The retaining bands 32 on the outer surfaces of the jet attachments 10 are passed, compressed, through the holes 3 until they are once again able to spring open in the area around the chamfers 33. The jet insert 1*b* is now once again "fastened" on to the perforated plate 1*a*.

With the shower base described, it is therefore possible to clean limescale deposits from the jet insert 1*b* without removing the perforated plate 1*a* from the shower head. Moreover, the base plate 9 of the jet insert 1*b* which extends along the entire outer surface of the perforated plate la protects the shower base from damage by impacts, especially in the rounded outer area.

FIG. 2 shows a second embodiment of a shower base in radial section, which is very similar to the embodiment described above with the aid of FIG. 1. Common parts are therefore marked with the same reference number, plus 100.

FIG. 2 once again shows a perforated plate 101*a* which, together with a jet insert 101*b*, form the shower base 101 of a shower head. The perforated plate 101*a* contains a number of holes 103 arranged in concentric circles about its centre axis.

The jet insert 101*b* consists of a base plate 109 in one piece and also jet attachments 110 preformed on to the base plate 109, each of which has jet channels 113 going axially through them. As can be seen from FIG. 2, the outer diameter of the jet attachments 110 is clearly smaller than the diameter of the corresponding holes 103 in the perforated plate 101*a*.

There are now preformed on to the base plate 109 of the jet insert 101*b* additional retaining collars 120 arranged concentrically about each jet attachment 110, the outer diameters of which are the same as the diameters of the holes 103 in the perforated plate 101*a*. The retaining collars 120 have a retaining band 132 on their upwards-facing edge, i.e. the edge facing inside the shower head. This protrudes outwards on the inside of the perforated plate and, together with the corresponding retaining bands 132 on all the other jet attachments 110, secure the jet insert 101*b* to the perforated plate 101*a*.

The jet insert 101*b* can therefore be fitted to the perforated plate 101*a* by pushing the retaining collars 120 through the corresponding holes 103 in the perforated plate 101*a*, which is possible due to the elasticity of the material of which the jet insert 101*b* is made. As soon as the retaining bands 132 have passed through the holes 103, they spring open and in this way form a fastening for the jet insert 101*b*. The insertion of the retaining collars 120, and especially the retaining bands 132 preformed on to these into the holes 103 in the perforated plate 101*a* is made easier by a chamfer 122 at the outer end of the holes 103.

The shower head shown in FIG. 2 essentially differs from the one shown in FIG. 1 in that a circular space 140 is formed between each of the jet attachments 110 and the retaining collars 120. This circular space 140 makes it possible, even without removing the jet insert 101*b* from the perforated plate 101*a*, to flex the area around the water outlet openings 115, whereby the user strokes his hand, or his finger, applying pressure, along the lower (outer) surface of the jet insert 101*b* and by so doing deforms the jet insert 101*b* in the area around the water outlet openings 115. The flexing of the jet insert 101*b* which can be achieved in this way may, in many cases, be adequate to dislodge limescale which has built up on the wall of the jet channels 113. The removal of the jet insert 101*b* from the perforated plate 101*a*, as described above, is therefore necessary in the embodiment shown in FIG. 2 only in exceptional circumstances or at very long time intervals.

The shower head shown in FIG. 3 is a variant of the embodiment shown in FIG. 2. Parts which are common to those in FIG. 1 are marked with the same reference number, plus 200.

The main difference between the embodiments shown in FIGS. 2 and 3 is as follows:

Whilst in the embodiment shown in FIG. 2 the circular spaces 140 which surround the jet attachments 110 concentrically have the sole function of facilitating the flexing capability of the jet attachments 110, the circular spaces in the embodiment shown in FIG. 3 have an additional function:

As can be seen in FIG. 3, the base of the circular spaces 240 is connected to the outer surface of the shower base, i.e. the outer surface of the base plate 209, via openings 250. The openings 250 have the form of ring segments, which surround the outlet openings 215 concentrically.

The shower base 201 shown in FIG. 3 is fitted inside the shower head in the following manner:

The free ends of the jet attachments 210 which face upwards as shown in FIG. 3 are attached to a dividing wall in the shower head so that the jet channels 213 connect with a water chamber which is on the side of the dividing wall facing away from the shower base 201.

The circular spaces 240, on the other hand, are connected to a second water chamber which is provided on the side of the dividing wall facing the shower base 201.

The embodiment shown in FIG. 3 operates as follows:

In one mode of operation of the shower, the supply water is conveyed to the water chamber which lies on the side of the dividing wall which faces away from the shower base 201. The water then flows through the jet channels 213 in the jet attachments 210 and comes out of the water outlet holes 215 in the form of "hard jets".

In the second mode of operation of the shower head, the water chamber which is adjacent to the shower base 201 is connected to the water supply. The water which takes this path has air, for example, added to it, passes into the circular chambers 240 and from there emerges via the openings 250 as "soft jets". The rough position of the "soft jets" on the shower base 201 is therefore essentially the same as that of the "hard jets" which means, therefore, that the jet pattern of the shower head is essentially the same in both modes of operation.

I claim:

1. A shower head, comprising:

a) an essentially bell-shaped housing in which at least one water chamber is formed which can be linked with a water supply channel;

b) a shower base, which seals a bottom of the bell-shaped housing and comprises:

ba) a perforated plate made of a rigid material, which has a number of holes;

bb) a jet insert made of a flexible material which can be detached from the perforated plate, which consists of a base plate pressing against one surface of the perforated plate and a number of hose-type jet attachments which are preformed in one piece onto the base plate, each of which has a jet channel terminating in a water outlet opening going through them and each of which pass through a hole in the perforated plate, wherein:

c) the base plate (9; 109; 209) of the jet insert (1*b*, 101*b*, 201*b*) rests against the outer surface of the perforated plate (1*a*, 101*a*, 201*a*), and d) the jet attachments (10, 110, 210) are pushed through the holes (3, 103, 203) in the perforated plate (1*a*, 101*a*, 201*a*), from the outside such that their free ends are located inside the shower head.

2. Shower head according to claim 1, characterised in that a) the outer diameter of the jet attachments (10) of the jet insert (1*b*) is the same as the diameter of the holes (3) in the perforated plate (1*a*), and b) there is preformed on the outer surfaces of each of the jet attachments (10), a radially protruding retaining band (32) which, when mounted, rests against the inner surface of the perforated plate (1*a*).

3. Shower head according to claim 2, characterised in that the retaining band (32; 132; 232) rests against a chamfer (33; 133; 233) at the inside end of the corresponding hole (3; 103; 203).

4. Shower head according to claim 1, characterised in that a) the outer diameter of the jet attachments (110; 210) of the jet insert (101*b*; 201*b*) is smaller than the diameter of the holes (103; 203) in the perforated plate (101*a*; 201*a*);

b) there are preformed on the base plate (109, 209) of the jet insert (101*b*; 201*b*) retaining collars (120; 220), each of which goes around the jet attachment (110; 210) and has the same outer diameter as the diameter of the holes (103; 203) in the perforated plate (101*a*; 201*a*);

c) preformed onto the outer surface of each of the retaining collars (120; 220) is a radially protruding retaining band (132; 232) which, when mounted, rests against the inner surface of the perforated plate (101*a*; 201*a*).

5. Shower head according to claim 4, characterised in that the circular spaces (240) going round the jet attachments (210) of the jet insert (201*b*) are connected to a water chamber which, when the shower head is in operating mode, supplies water and is, in addition, connected to the outer surface of the shower base (201) via ring-segment shaped openings (250).

* * * * *